United States Patent [19]

Billon

[11] Patent Number: 4,943,201

[45] Date of Patent: Jul. 24, 1990

[54] MECHANISM FOR HANDLING GARBAGE PAILS

[75] Inventor: Jean Billon, Saint-Vallier, France

[73] Assignee: Compagnie Plastic Omnium, S.A., Lyons, France

[21] Appl. No.: 195,619

[22] Filed: May 18, 1988

[30] Foreign Application Priority Data

Apr. 15, 1987 [FR] France ..... 87 05394

[51] Int. Cl.[5] ..... B65F 3/04

[52] U.S. Cl. ..... 414/408; 414/421; 414/425

[58] Field of Search ..... 414/403, 404, 406, 408, 414/425, 421

[56] References Cited

U.S. PATENT DOCUMENTS

| | | | |
|---|---|---|---|
| 3,884,376 | 5/1975 | Rivers | 414/421 |
| 3,894,642 | 7/1975 | Shive | 414/421 X |
| 4,305,693 | 12/1981 | Naab | 414/408 X |
| 4,422,814 | 12/1983 | Borders | 414/421 X |
| 4,580,940 | 4/1986 | Sheaves | 414/421 X |
| 4,673,327 | 6/1987 | Knapp | 414/408 |
| 4,687,405 | 8/1987 | Olney | 414/408 |

FOREIGN PATENT DOCUMENTS

| | | | |
|---|---|---|---|
| 1201756 | 9/1965 | Fed. Rep. of Germany | 414/408 |
| 2303063 | 7/1974 | Fed. Rep. of Germany . | |
| 2558466 | 6/1984 | Fed. Rep. of Germany | 414/406 |
| 2515929 | 12/1985 | Fed. Rep. of Germany . | |
| 2153053 | 9/1972 | France . | |
| 2523559 | 3/1983 | France . | |

*Primary Examiner*—Frank E. Werner
*Assistant Examiner*—Robert S. Katz
*Attorney, Agent, or Firm*—Schweitzer & Cornman

[57] ABSTRACT

The invention relates to a mechanism in a bin-dumping device for gripping portable bins, to empty them into a truck for collecting waste, particularly household garbage, the gripping mechanism comprising a chassis connected to the dumping device and having at its upper part one or several shaped sections, particularly in the shape of a comb, adapted to be engaged under a collar provided at the upper end of the frontal wall of the body of the bin. It comprises, at the lower part of the chassis (1), at least one support devices (7) adapted to come into contact with the frontal face (5) of the bin (4), preferably at its lower half, said one or more devices being controllable for being applied forcefully to the bin during at least part of its path of displacement, during the operation of the dumping device.

2 Claims, 3 Drawing Sheets

MECHANISM FOR HANDLING GARBAGE PAILS

BACKGROUND OF THE INVENTION

The present invention relates to a mechanism in a bin-dumping device for gripping portable bins, to empty them into a truck for collecting waste, particularly household garbage.

For the last several years, an increase has been observed in the growth of mechanized waste collection, particularly in the collection of household waste. For this purpose, waste collection trucks are used, having at their rear part a device which permits loading one, or simultaneously several, filled collection bins, lifting them and dumping them, to empty their contents into the interior loading space of the truck.

The dumping device comprises a gripping mechanism permitting one or several bins to be held on the device during the phases of lifting, dumping, and subsequently resting them on the ground after emptying.

Different types of gripping mechanisms are known.

Among these, the so-called frontal gripping mechanism is currently used, comprising a chassis connected to the dumping device, having at its upper part one or several shaped sections, particularly in the shape of a comb, adapted for being engaged under a collar provided at the upper end of the frontal wall of the body of the bin.

The applicant company makes and distributes portable bins having different capacities, made of plastic material, provided with such a collar, these bins having small wheels at the lower part of the body, and an articulated cover at its upper part.

To avoid the unhooking of the bin during its dumping movement, as it attains, and then passes, a detectably horizontal position, it is necessary to provide mechanical means on the dumping device, such as support bars, which provide a pinching effect from above, on the collar in which the shaped section of the gripping mechanism is engaged.

This mechanical pinching effect causes substantial stresses, particularly torsional, on the collar, which can cause its rapid deterioration and can thereby make the bin unsuitable for proper utilization.

These substantial stresses make it necessary to provide the collar with rigidifying means, particularly in the form of ribs, thus complicating the manufacture of the bin.

SUMMARY OF THE INVENTION

The present invention provides a gripping mechanism which remarkably reduces the stresses applied to the collar, increasing the service life and simplifying the manufacture of the bins, while reducing the substantiality of the means for rigidifying the collar.

The mechanism according to the invention is characterized by the fact that it comprises at the lower part of the chassis at least one support means adapted to come into contact with the frontal face of the bin, preferably at its lower half, said one or more means being controllable for being applied forcefully to the bin during at least part of its displacement path, during the operation of the dumping device.

In a particular embodiment, the or each support means is constituted by a suction cup connected to a suction circuit.

Preferably, suction by the one or more suction cups is activated during the dumping movement of the bin, before it attains a detectably horizontal position, the suction being maintained until the bin, after completing the phase of dumping and emptying, returns to a nearly horizontal position, during the phase of bringing it back to the ground. For this purpose, there are provided, according to the invention, contact switches disposed along the displacement path of the dumping device, and whose activation controls the operation of solenoid valves connected to a vacuum pump, which is activated preferably by the motor of the collection truck.

In another embodiment of the invention, the one or more support means are constituted by electromagnets whose activation is also controlled by the contact switches placed in the displacement path of the dumping device.

For collection bins made of plastic material, this second embodiment assumes that a metallic plate or sheet has been put in place on or inside the frontal wall of the bin.

In order to better explain the invention, an embodiment thereof will be described, as a non-limiting example, with reference to the attached drawing, in which:

DETAILED DESCRIPTION OF THE INVENTION

Figure 1:
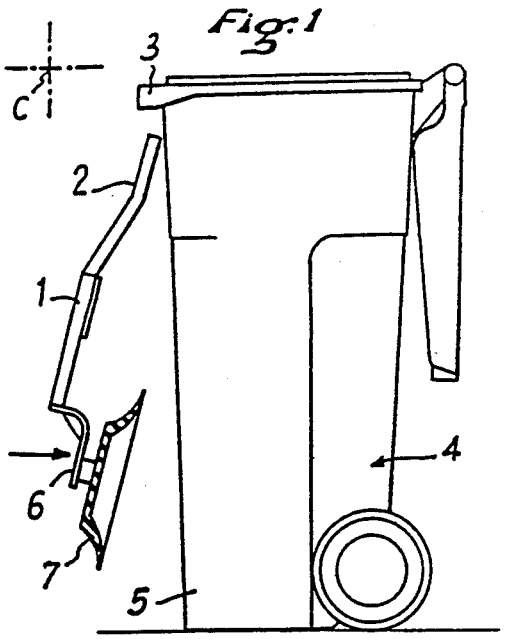
FIG. 1 is a schematic side elevational view of the gripping mechanism according to the invention, before loading a portable bin.

First, refer to FIGS. 1–5.

This drawing illustrates an embodiment of a gripping mechanism, comprising a chassis 1 for being fixed on a dumping device (not shown), on the back of a truck for collecting waste, particularly household garbage.

The mechanism according to the invention can be mounted on existing dumping devices without entailing any substantial modifications thereof.

At the upper part of the chassis are mounted, in the illustrated embodiment, two shaped sections 2 having an upper end in the shape of a comb, for engagement in the collar 3 of a portable bin 4, the collar 3 being provided at the upper end of the frontal face 5 of the bin.

According to the invention, the gripping mechanism comprises two suction cups 7 which are fixed by arms 6 to the lower part of the chassis 1, and which are connected to a suction circuit which will be described in greater detail with reference to FIG. 7.

Figure 5:
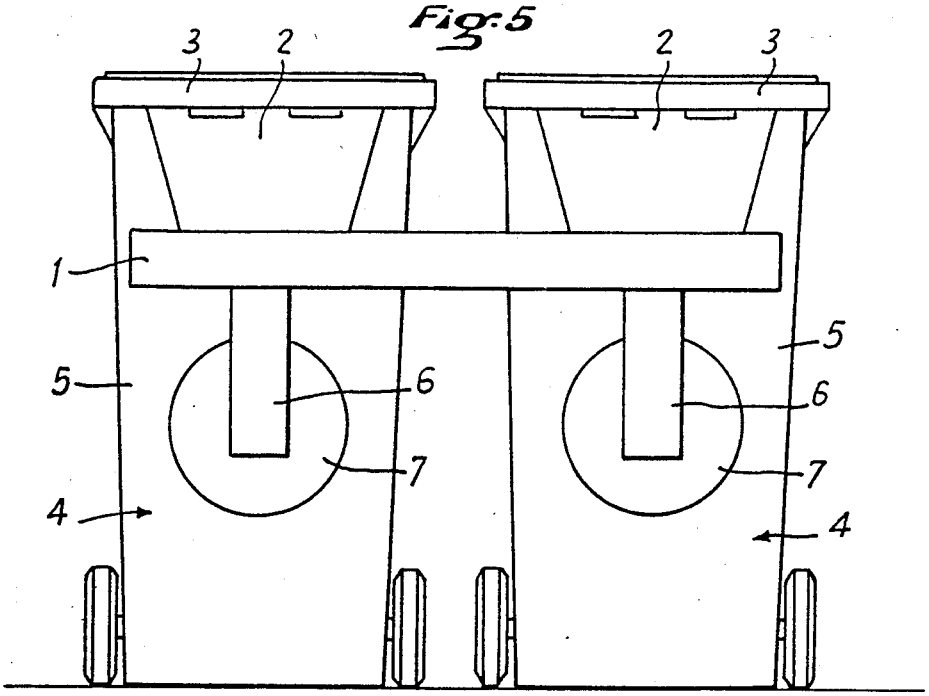
FIG. 5 is a schematic rear view of a mechanism according to the invention, utilized for the simultaneous gripping of two bins.
Figure 6:
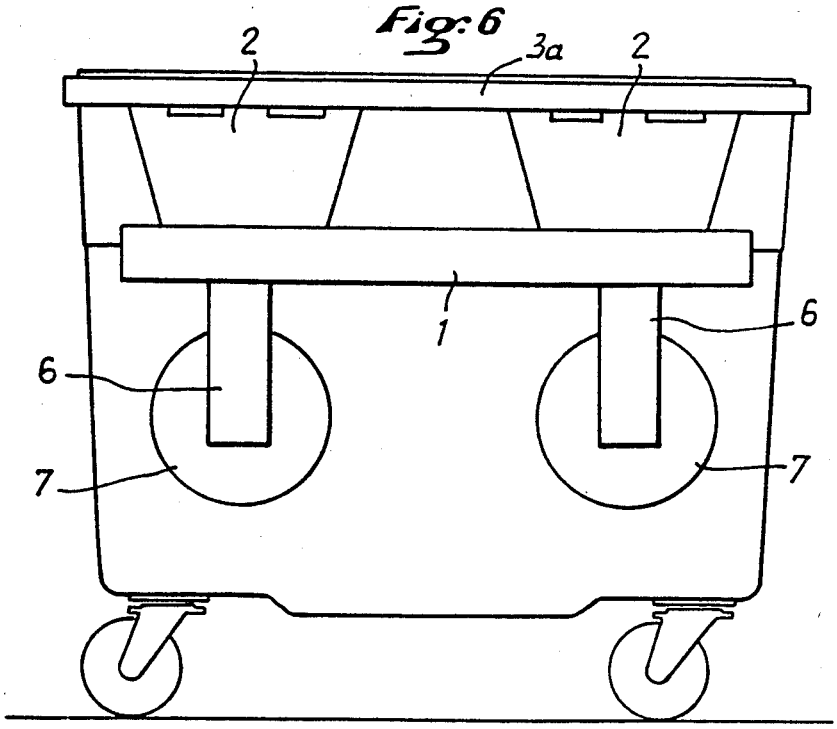
FIG. 6 is a view analogous to FIG. 5, showing the utilization of the mechanism for gripping only one large-capacity bin.

The drawing illustrates an embodiment of a type having two suction cups. The embodiment is advantageous in that this form of gripping mechanism permits, as illustrated in FIG. 5, the simultaneous loading of two bins of large or medium capacity (for example 120 or 240 liters), or as illustrated in FIG. 6, the loading of only one high-capacity bin, for example 600 liters or more, the two shaped sections 2 being now engaged under the collar 3*a* of the bin, and the two suction cups 7 both being able to be applied to the front wall of the bin.

Figure 2:
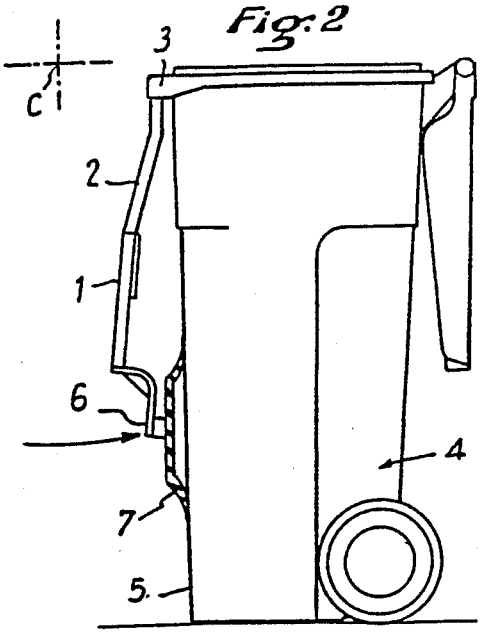
FIGS. 2–4 illustrate the mechanism of FIG. 1, after loading a bin, during successive phases of dumping.

The mechanism according to the invention operates in the following manner:

Starting with the position of FIG. 1, in which the one or more bins are brought to the vicinity of the mechanism for being loaded, the dumping device is then activated, and as illustrated in FIG. 2, the or each shaped section 2 is engaged under the corresponding collar 3 of the bin, and simultaneously the suction cup 7 comes into contact with the frontal wall 5 of the bin in its lower half. In this phase, the one or more suction cups are not placed under suction, and operate like simple pressing feet.

Figure 3:
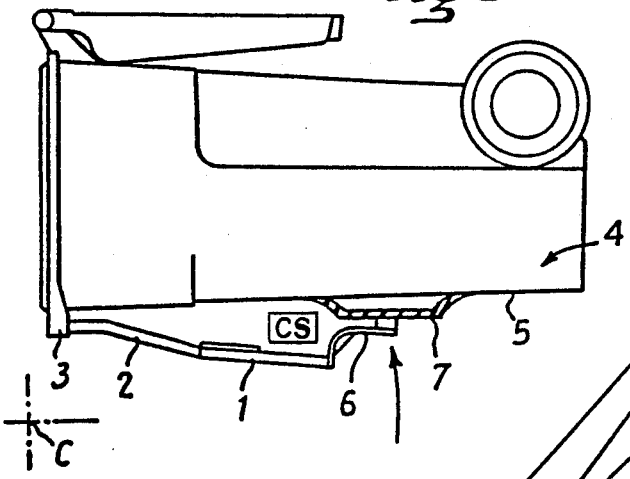
Figure 4:
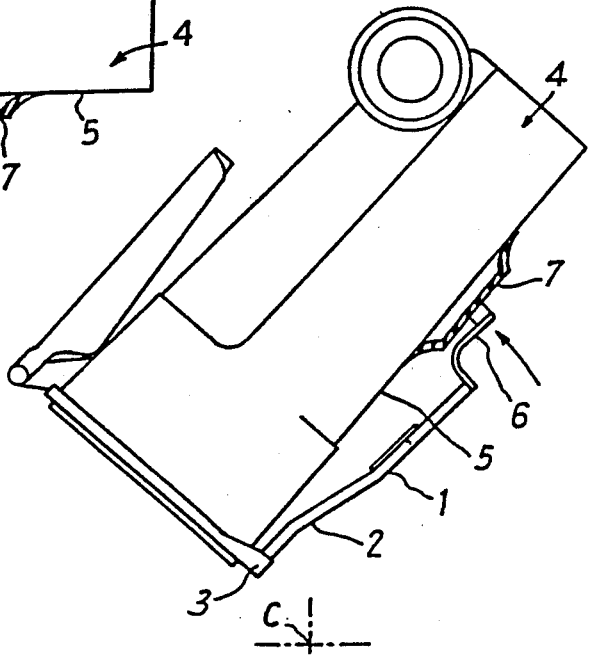

When, as illustrated in FIG. 3, the bin approaches a nearly horizontal position under the action of the dumping device, whose axis of rotation is indicated schematically at C, this position being detected by a contact switch 14 placed in the displacement path of the dumping device, the one or more suction cups are then placed under suction and are applied with substantial force against the corresponding wall of the bin, assuring perfect retention of the bin on the gripping mechanism, in cooperation with the shaped sections 2 engaged under the collar, particularly during the subsequent emptying phase, as illustrated in FIG. 4.

Once the emptying of the bin has been completed, the dumping device returns the bin to the ground. The suction applied to the suction cups is suppressed when the bin passes through a nearly horizontal position.

Figure 7:
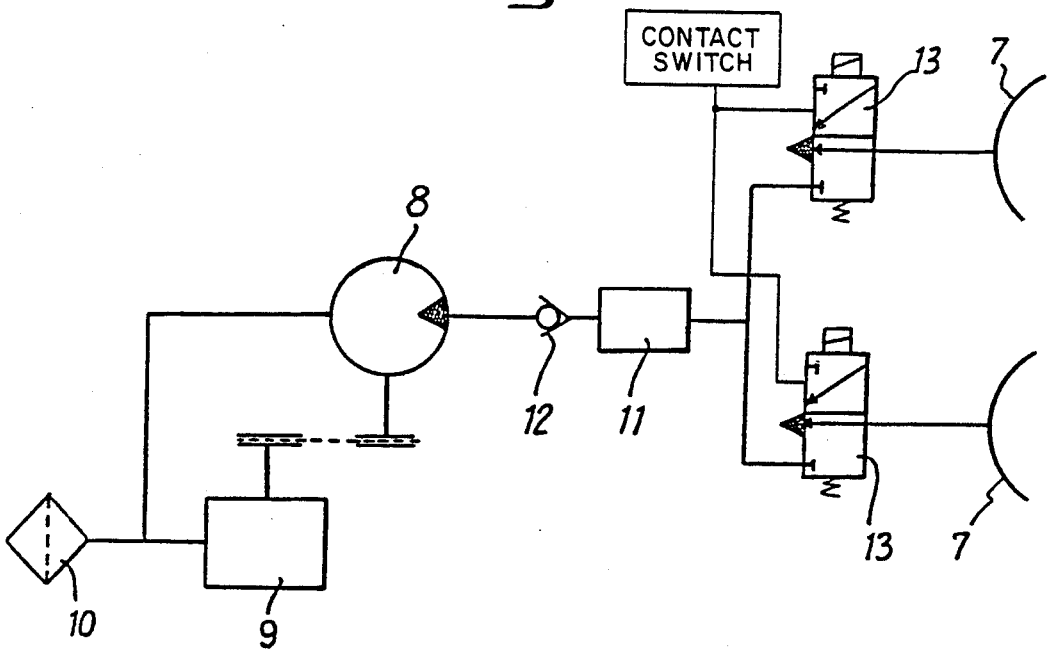
FIG. 7 schematically illustrates the suction circuit for the suction cups of the mechanism of FIGS. 1–6.

Now refer to FIG. 7.

The suction control circuit for the suction cups 7 comprises a vacuum pump 8 driven by the motor 9 of the truck, said pump also being connected to the air filter 10 of the truck.

According to the invention, a small vacuum reservoir 11 is provided, which is connected to the vacuum pump 8 by a non-return valve 12, and is connected to two solenoid valves 13 provided in parallel, each being connected to one of the suction cups 7.

Each of the solenoid valves 13 is controlled by a contact switch 14 placed in the displacement path of the dumping device.

Although the invention has been described in connection with a particular embodiment thereof, it is in no way limited thereby, and numerous variations and modifications can be carried out without departing from either the scope or the spirit thereof.

In particular, the invention is not limited to a pneumatic support device with two suction cups, but may be carried out with one or several support means, not only pneumatic, but also electromagnetic, for example.

I claim:

1. A gripping mechanism in a bin-dumping device for gripping portable waste bin bodies having planar frontal walls with collars at the upper end thereof to empty said bin bodies into a collection truck, said mechanism comprising a chassis connected to the dumping device, characterized by the fact that the chassis at upper portions thereof has at least one comb-shaped section adapted to be engaged under the collar provided at the upper end of the frontal wall of the bin body and the chassis having, at lower portion thereof, at least one suction cup support means adapted to contact the frontal face of a bin bodies; said one or more suction cup support means being controllable for being applied forcefully to the bin body during at least part of its displacement path during the operation of the dumping device; each support means being connected to a suction circuit including solenoid valves which place the one or more suction cup support means in communication with a vacuum pump adapted to be activated by a motor; said solenoid valves being controlled by contact switches, said contact switches being disposed in the displacement path of the dumping device; whereby said suction cup support means are controlled by said contact switches.

2. A gripping mechanism according to claim 1, characterized by the fact that the suction circuit of the one or more suction cup support means is activated during the dumping movement of the bin body before it attains a detectable horizontal position, the suction being maintained until the bin body, returns to a nearly horizontal position, as it is returned to the ground after its content have been dumped.

* * * * *